United States Patent [19]

Johnson

[11] Patent Number: 5,038,487

[45] Date of Patent: Aug. 13, 1991

[54] ATTACHMENT FOR FRAMER'S SQUARE

[76] Inventor: Roy E. Johnson, 12308 Aegean St., Norwalk, Calif. 90650

[21] Appl. No.: 637,808

[22] Filed: Jan. 7, 1991

[51] Int. Cl.[5] ..... B43H 7/10

[52] U.S. Cl. ..... 33/480; 33/489; 33/484; 33/481; 33/430; 33/433

[58] Field of Search ..... 33/484, 481, 480, 479, 33/474, 485, 489, 490, 403, 430, 433, 437, 468, 492, 429; 40/120, 606

[56] References Cited

U.S. PATENT DOCUMENTS

| | | | |
|---|---|---|---|
| 768,324 | 8/1904 | Breul | 33/429 |
| 1,237,790 | 8/1917 | Kidder | 33/420 |
| 1,374,815 | 4/1921 | Breul | 33/429 |
| 1,374,816 | 4/1921 | Breul | 33/429 |
| 4,495,709 | 1/1985 | Mainenti | 33/484 |
| 4,570,345 | 2/1986 | Cattadoris | 33/403 |

FOREIGN PATENT DOCUMENTS

| | | | |
|---|---|---|---|
| 0170589 | 3/1952 | Austria | 33/480 |

*Primary Examiner*—William A. Cuchlinski, Jr.
*Assistant Examiner*—William C. Dowling
*Attorney, Agent, or Firm*—Edgar W. Averill, Jr.

[57] ABSTRACT

An attachment for a framer's square which permits the framer's square to be self supporting on a flat, horizontal surface. The attachment has an elongated support bar with two clips which may be inserted over a blade of a framer's square. This attachment, when inserted on the inner edge of the framer's square, facilitates the scribing of a right-angle line to a rounded edge and when placed on an outer edge, permits the square to be free standing.

8 Claims, 1 Drawing Sheet

ATTACHMENT FOR FRAMER'S SQUARE

BACKGROUND OF THE INVENTION

The field of the invention is carpenters' tools, and the invention relates more particularly to carpenters' squares of the type generally referred to as framing squares. Framing squares typically have two blades held at a right angle to one another, namely, a longer blade and a shorter blade. It is often desired to place a two-by-four or other structural member at a right angle to a generally horizontal plate. In the past, it was necessary to hold the framer's square in one hand while attempting to hold the two-by-four in the other hand which was very awkward for an unassisted carpenter.

Various square attachments are known such as shown in U.S. Pat. Nos. 768,324; 1,237,790; and 1,374,816 which show attachments to miter squares. A scale stabilizer is shown in U.S. Pat. No. 4,864,734, and an adjustable carpenter's square is shown in the patent to Mayer U.S. Pat. No. 2,797,487. None of these patents permit the free standing support of a framer's square in an accurate, vertical position.

It is an object of the present invention to provide an attachment for a framer's square which permits the framer's square to be free standing and which also facilitates the scribing of lines at a right angle to an edge of a surface such as a table top.

The present invention is for an attachment for a framer's square of the type having a longer blade and a shorter blade held at right angles to each other and each blade having an outer edge and an inner edge, first and second faces and a blade thickness. The attachment is an elongated support bar having a flat bottom surface and an upper surface to which first and second clip members are affixed. The clip members have an elastic clip opening which is positioned exactly at a 90° angle with respect to the bottom surface of the elongated support bar. The clip openings have a width less than the thickness of the blades of the framing square, and each clip member has a base, each of which are spaced at exactly the same different distance from the bottom surface of the elongated support bar. This permits the first and second clip members to be fully inserted onto one of the blades of the framing square and for the framing square to be placed on a flat, horizontal surface and be free standing with one of the blades of the square at a 90° angle with respect to the flat surface.

DESCRIPTION OF THE PREFERRED EMBODIMENTS

Figure 1:
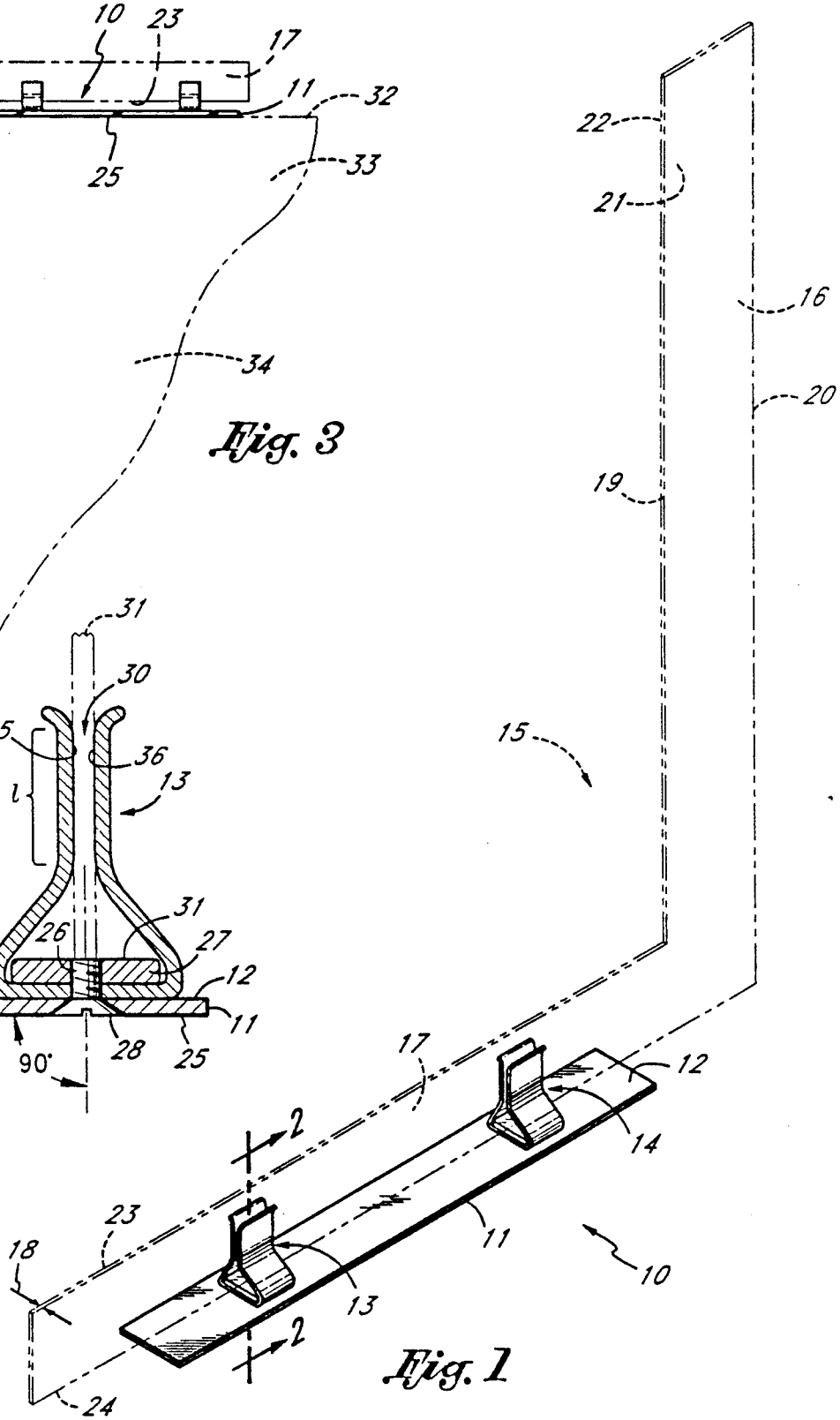
FIG. 1 is a perspective view of the framing square attachment of the present invention shown together with a framing square shown in phantom view.

An attachment for a framer's square is shown in perspective view in FIG. 1 and indicated generally by reference character 10. Attachment 10 includes an elongated support bar 11 having an upper surface 12 to which a first clip member 13 and a second clip member are secured. A framer's square is shown in phantom view and indicated by reference character 15. Framer's square 15 has a longer blade 16 and a shorter blade 17, each of which have a blade thickness 18. Longer blade 16 has an inner edge 19, an outer edge 20, a first face 21 and a second face 22. Similarly, shorter blade 17 has an inner edge 23, an outer edge 24, and likewise has a first face 21 and a second face 22.

Figure 2:
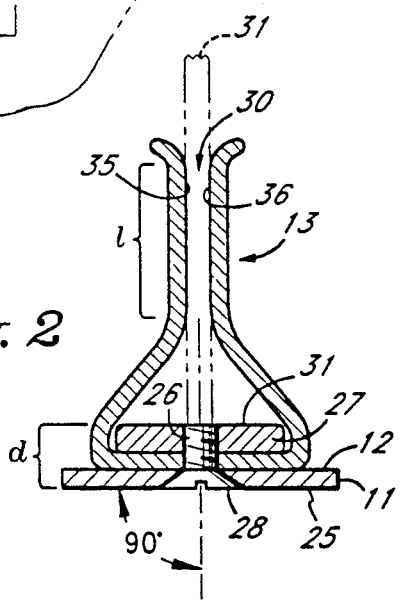
FIG. 2 is an enlarged cross-sectional view taken along line 2—2 of FIG. 1.

The details of the attachment 10 are shown best in FIG. 2 where it can be seen that the elongated support bar 11 has a flat bottom surface 25 which is parallel to upper surface 12. First and second clip members 13 and 14 are identical, and as shown in FIG. 2, clip member 13 is secured to elongated support bar 11 by a screw 26 which is threaded into a base bar 27. Screw 26 has a flat head 28 which is countersunk into elongated support bar 11 so that it does not extend beyond flat bottom surface 25. Clip member 13 has an elastic clip opening 30 which has an opening width 31 which is less than blade thickness 18 so that the clip opening 30 will securely grasp the blade of the framer's square to which it is affixed. The upper surface of base bar 27 provides an opening base 31 which contacts the edge of the framer's square to which it is inserted. This opening base 31 is at a distance represented by reference character "d" from flat bottom surface 25. It is important that clip members 13 and 14 be constructed so that this distance "d" is the same so that the flat bottom surface 25 is parallel to outer edge 24 as well as inner edge 23.

It can be seen when the elongated support bar is affixed to the shorter blade 17, as shown in FIG. 1, that the framer's square 15 can be supported in a free-standing manner on a flat, horizontal surface.

Figure 3:
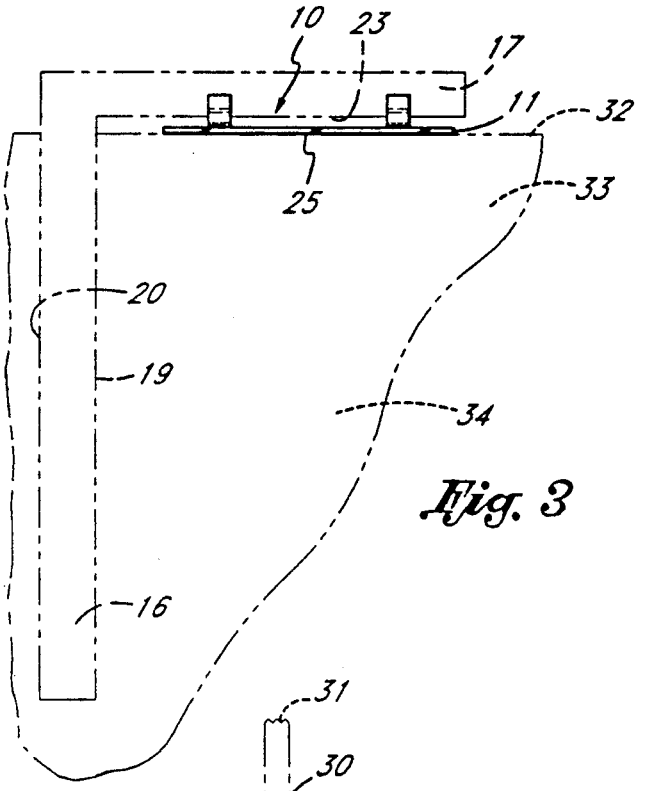
FIG. 3 is a side view of the attachment of FIG. 1 affixed to the inner edge of a framer's square shown in phantom view.

Another benefit of the attachment of the present invention is indicated by reference to FIG. 3 where attachment 10 is affixed to inner edge 23 of shorter blade 17 This permits the flat, bottom surface 25 of the elongated support bar 11 to be placed against an edge 32 of a member 33 to permit a scribe to be made along either the inner edge 19 or the outer edge 20 of longer blade 16 on the upper surface 34 of member 33. This would be possible even if edge 32 was rounded such as many desk tops or tables are. Attachment 10 is securely affixed to the blade of the framer's square and provides a secure and accurate surface for this purpose.

Member 13 is preferably fabricated from spring steel or other elastic material. Clip 13 should be made of a material having a thickness which will not permit it to easily bend once inserted on a blade of a framing square. The elongated support bar 11 is preferably fabricated from steel similar to that used for the framing square itself.

It would be possible to fabricate the attachment of the present invention from a single unitary piece. The clip portion thereof should have opposed straight, vertical lengths "1," as shown in FIG. 2, along a portion of the edges 35 and 36 of the elastic clip opening 30. This length "1" should be at least 0.25 inch so that the clip member securely holds the square at a right angle with respect to the flat bottom surface 25.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

WHAT IS CLAIMED IS:

1. An attachment for a framer's square, said framer's square being of the type having a longer blade and a shorter blade precisely at a right angle thereto and said blades each having an outer edge and an inner edge, first and second faces and a blade thickness, wherein the attachment comprises:

an elongated support bar having a flat bottom surface and an upper surface;

clip means affixed to said elongated support bar, said clip means having an elastic clip opening exactly at a 90° angle with respect to the bottom surface of said elongated support bar, said elastic clip opening of said clip means having an opening width less than the thickness of said longer and shorter blades, and said elastic clip opening of said clip means having an opening base at the same distance from the flat bottom surface of said elongated support bar, whereby when said clip means is placed on a blade of a framing square sufficiently far so that the blade contacts the opening base of each clip member and the bottom surface of said elongated bar is placed against a flat surface, the framing square will be held at a right angle with respect to the flat surface and, furthermore, if the bottom surface is placed on the upper surface of a horizontal member, the framing square will be free standing.

2. The attachment for a framer's square of claim 1 wherein the elastic clip portion of said clip means has opposed straight vertical lengths which are generally parallel to one another and perpendicular to said flat bottom surface of said elongated support bar.

3. The attachment for a framer's square of claim 2 wherein said opposed straight vertical lengths are at least 0.025 inch in length.

4. The attachment for a framer's square of claim 2 wherein said elastic clip means is fabricated from spring steel.

5. An attachment for a framer's square, said framer's square being of the type having a longer blade and a shorter blade precisely at a right angle thereto and said blades each having an outer edge and an inner edge, first and second faces and a blade thickness, wherein the attachment comprises:

an elongated support bar having a flat bottom surface and an upper surface;

first and second clip members affixed to the upper surface of said elongated support bar, each of said clip members having an elastic clip opening exactly at a 90° angle with respect to the bottom surface of said elongated support bar, said elastic clip opening of each clip having an opening width less than the thickness of said longer and shorter blades, and said elastic clip opening of each clip member having an opening base at the same distance from the flat bottom surface of said elongated support bar, whereby when said first and second clip members are placed on a blade of a framing square sufficiently far so that the blade contacts the opening base of each clip member, and the bottom surface of said elongated bar is placed against a flat surface, the framing square will be held at a right angle with respect to the flat surface and, furthermore, if the bottom surface is placed on the upper surface of a horizontal member, the framing square will be free standing.

6. The attachment for a framer's square of claim 5 wherein the elastic clip portions of said first and second clip members have opposed straight vertical lengths which are generally parallel to one another and perpendicular to said flat bottom surface of said elongated support bar.

7. The attachment for a framer's square of claim 6 wherein said opposed straight vertical lengths are at least 0.025 inch in length.

8. The attachment for a framer's square of claim 6 wherein said elastic clip members are fabricated from spring steel.

* * * * *